US005258900A

United States Patent [19]

Bayer

[11] Patent Number: 5,258,900

[45] Date of Patent: Nov. 2, 1993

[54] CHANDELIER ASSEMBLY AND KIT HAVING ARM LOCKING PLATES

[75] Inventor: Georg Bayer, Plattsburgh, N.Y.

[73] Assignee: Schonbek Worldwide Lighting Inc., Plattsburgh, N.Y.

[21] Appl. No.: 813,124

[22] Filed: Dec. 23, 1991

[51] Int. Cl.[5] ..... F21S 1/06

[52] U.S. Cl. ..... 362/405; 362/450; 362/806

[58] Field of Search ..... 362/405, 339, 406, 806, 362/408, 450, 434; D26/81, 82, 84, 88, 90, 141, 143

[56] References Cited

U.S. PATENT DOCUMENTS

| | | | |
|---|---|---|---|
| 1,035,061 | 8/1912 | Trood | 362/405 |
| 1,530,993 | 3/1925 | Framburg | 362/406 |
| 1,644,452 | 10/1927 | Spencer | 362/408 |
| 2,437,350 | 3/1948 | Ferlin et al. | 362/241 |
| 3,113,679 | 12/1963 | Smith | 211/118 |
| 3,979,584 | 9/1976 | Fossati | 362/405 |
| 4,477,866 | 10/1984 | Goralnik | 362/427 |

*Primary Examiner*—Albert J. Makay
*Assistant Examiner*—Alan B. Cariaso
*Attorney, Agent, or Firm*—Wolf, Greenfield & Sacks

[57] ABSTRACT

A chandelier assembly and kit includes a first and second plate, each having opposing substantially planar surfaces. First and second openings are provided in the first and second plates, respectively. These openings are constructed and arranged so that an ornament bearing arm is biased into locking engagement and secured against rotation, but preferably is free of engagement with the planar surfaces of the plates when assembled. The openings are configured so as to provide a restrictive portion that frictionally engages the arm to prevent rotation when the arm is positioned at a specified angle. The openings also each include a non-restrictive portion that allows the arm to readily pass without frictional engagement. Assembly and disassembly is permitted simply by biasing the arm into and out of frictional engagement with the plates.

17 Claims, 6 Drawing Sheets

CHANDELIER ASSEMBLY AND KIT HAVING ARM LOCKING PLATES

FIELD OF THE INVENTION

The present invention relates generally to chandeliers and, more particularly, to chandelier assemblies having plates for interlocking chandelier arms.

DESCRIPTION OF THE PRIOR ART

"Shower" type chandeliers have been constructed generally by welding or brazing arms to a central hub. FIG. 1*a* shows a first example of a conventional "shower" type chandelier. This type of chandelier assembly 10 is referred to as a "shower" chandelier because of the showering effect produced by the numerous radiused scroll arms that extend from the central flat washer 11. FIG. 1*a* shows only one radial row of such scroll arms 12 so as to more clearly display the features of the assembly. Conventionally, multiple rows of scroll arms 12 are attached to the flat washer 11 about the entire top surface of the washer.

The scroll arms 12 are rolled "on-the flat" (i.e. rolled on the wider flat surface of the scroll) to create their arcuate shape. A 90° bend is provided at the radially innermost end of the scroll arms 12 to form feet 14 that abut the top surface of the flat washer 11. The feet 14 are welded to the top surface of the flat washer 11. The scroll arms 12 may hold ornaments, lights or other types of trim. Openings 16 can be provided in the radially outermost end of the scroll arms 12 for holding trim. A central opening 17 in the washer is provided for passing the washer 11 over a stem of a chandelier fixture.

Unfortunately, the "shower" type chandelier of FIG. 1*a* suffers from a number of drawbacks. First, because the scroll arms 12 are rolled "on the flat", they are not adequately resistant to axial displacement caused by the weight of trim that is suspended from the scroll arms. Second, alignment of the scroll arms 12 on the washer 11 during welding is difficult, time consuming, expensive and unreliable. A single weld fault may cause serious problems with respect to repair. Lastly, because the axial alignment of the scroll arms is performed during welding when no trim is hung from the scrolls, the geometric alignment of the chandelier when loaded with trim differs from the alignment when the chandelier is not loaded with trim. As a result, geometric misalignment may arise.

A second type of conventional "shower" chandelier is depicted in FIG. 1*b*. In this chandelier, the scroll arms 18 are not welded to a flat washer, but rather are welded to the sides of stamped, nested, metal cups 20. These cups 20 are part of a central support structure that includes a top plate 22 and a bottom plate 24. An opening 26 provided in the bottom plate 24 of the support structure permits the structure to fit over a stem of the chandelier. Ornament attachment openings (not shown) can be provided in the radially outermost end of the scroll arms 18.

The "shower" type chandelier of FIG. 1*b* suffers from many of the drawbacks described above. In particular, the chandelier of FIG. 1*b* suffers from alignment problems and can be even more expensive and difficult to construct than the chandelier of FIG. 1*a*. Furthermore, the scroll arms 18 are rolled "on the flat", which results in arms having little strength to resist axial displacement caused by the load of trim. Still further, the fully constructed chandelier requires considerable hand bending to adjust the geometric alignment of the scroll arms 18.

In connection with both of these prior art chandeliers, the scroll arms are easily broken or bent during shipment. It also is difficult to clean or repair such chandeliers because each arm is not readily accessible.

It is therefore an object of the present invention to provide a chandelier assembly that is easily and inexpensively constructed.

Another object of the present invention is to provide a chandelier assembly wherein the arms are rolled on the edge so as to resist axial displacement caused by trim that is connected to the scrolls.

Another object of the present invention is to provide a chandelier assembly having arms that are easily and accurately aligned.

Another object of the present invention is to provide a chandelier assembly that is easily repaired and cleaned.

Yet another object of the present invention to provide a chandelier assembly that may be shipped without incurring breakage or bending.

SUMMARY OF THE INVENTION

The foregoing objects, as well as other advantages, are realized by the present invention in which a chandelier assembly includes a first plate having a first plate opening and a second plate attached to and spaced from the first plate, the second plate having a second plate opening aligned with the first plate opening. An arm for supporting an ornament is received within the openings. The ornament biases the arm in a first direction into an engagement with surfaces defining the openings that frictionally locks the arm to the plates. The openings and arm are constructed and arranged so that the arm may be released from frictional engagement with the plates when biased in a second direction substantially opposite to that of the first direction. In this manner, the arm may be assembled onto the supporting plates by a simple mechanical interengagement, without the need for welding or other attachment means such as screws or the like. The plates, of course, typically have an array of aligned openings for receiving arms to form a predetermined pattern. The invention thereby permits the arms and plates to be shipped prior to assembly, as they may be readily assembled on site (thereby avoiding damage during shipment and permitting easy disassembly for cleaning and repair).

In preferred embodiments, the arm can be a scroll that is rolled on edge so that the arm readily resists axial displacement. The openings and arm can be constructed and arranged so that the arm is free of engagement with the planar surfaces of the plates. This distinguishes the invention from certain prior art chandeliers which require a tongue-and groove interlocking. The chandelier assembly may include additionally a mechanism for controlling the position of the radially innermost end of the arms.

According to another aspect of the invention, the chandelier assembly has a first plate with a first plate opening tapered in a first direction and a second plate with a second plate opening tapered in a second direction. The first plate and second plate are attached to but spaced from one another, with the openings aligned such that the taper of the first opening is oriented 180 degrees relative to the taper of the second opening.

Different types of opening configurations may be employed to realize the interlocking engagement of the arms. Typically, each opening includes a non-restrictive portion that has a size greater than the cross-section of the engagement portion of the arms so that the arms may be passed readily through the non-restrictive portion when the arm is positioned at a first angle relative to the openings. Each opening also typically includes a restrictive portion having a size closely matched to at least a portion of the cross-section of the arms so that it closely engages an arm when the arm is positioned at a second angle relative to the opening. As a result, the arms may be readily moved through the non-restrictive portions of the aligned openings when the arm is positioned at the first angle. In contrast, the arms are interlockingly engaged by the restrictive portions of the openings when positioned at the second angle.

The openings and arms may be constructed and arranged such that the interlocking engagement prevents rotation of the arm, lateral movement of the arm and/or axial movement of the arm.

Plate assemblies as well as kits for manufacturing chandeliers also are provided.

BRIEF DESCRIPTION OF THE DRAWINGS

The present invention will be described in more detail below with reference to the drawings which include the following figures.

DETAILED DESCRIPTION

The present invention provides a chandelier assembly that does not require welding to attach arms to central plates. The arms are coupled to the plates through engagement with surfaces defining openings. The arms and openings can be constructed and arranged such that the arms are secured against lateral movement and rotation, as well as axial movement.

Figure 1A:
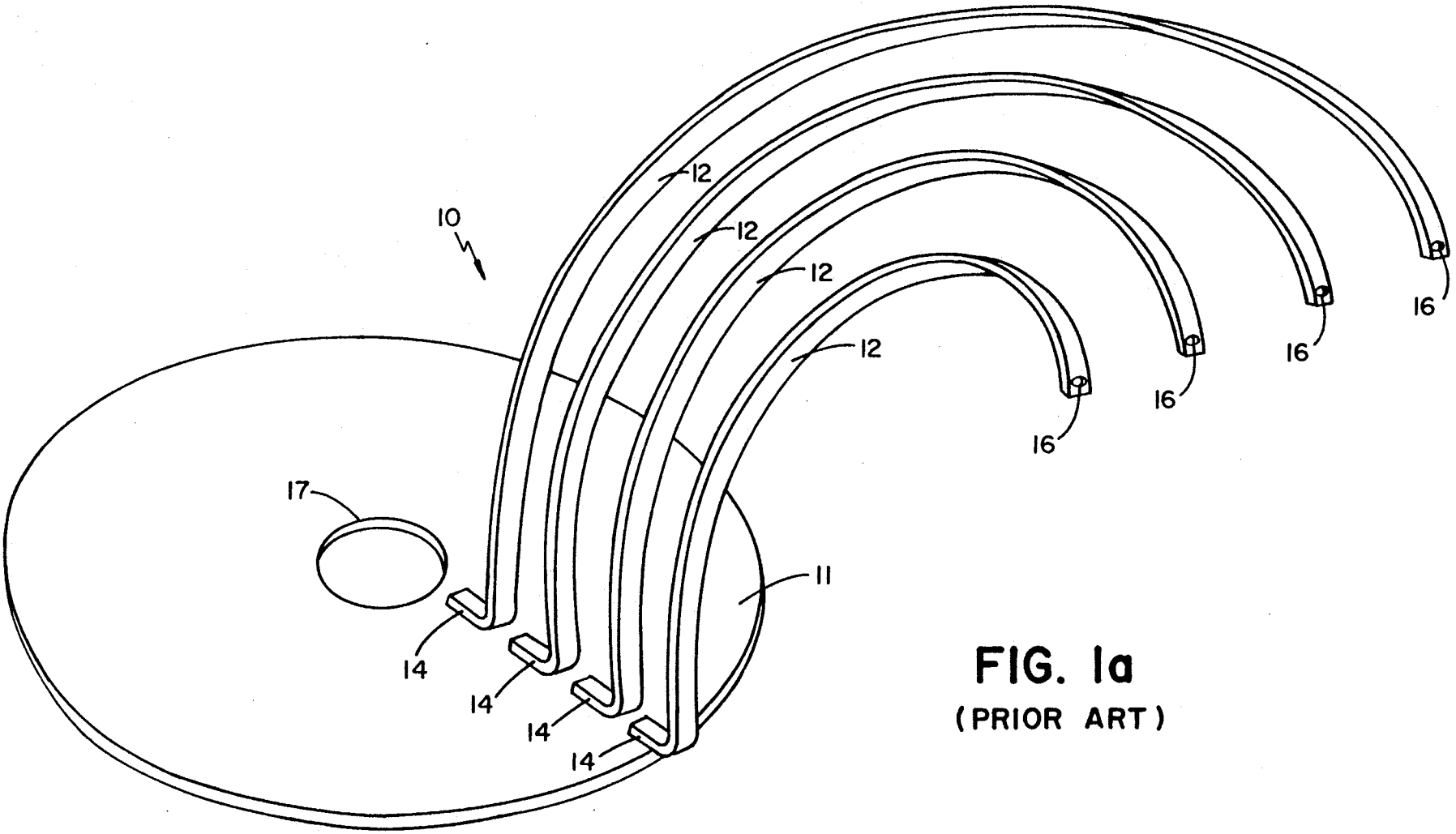
FIG. 1a (PRIOR ART)
FIG. 1*a* is a perspective view of a portion of a conventional "shower" type chandelier assembly.
Figure 1B:
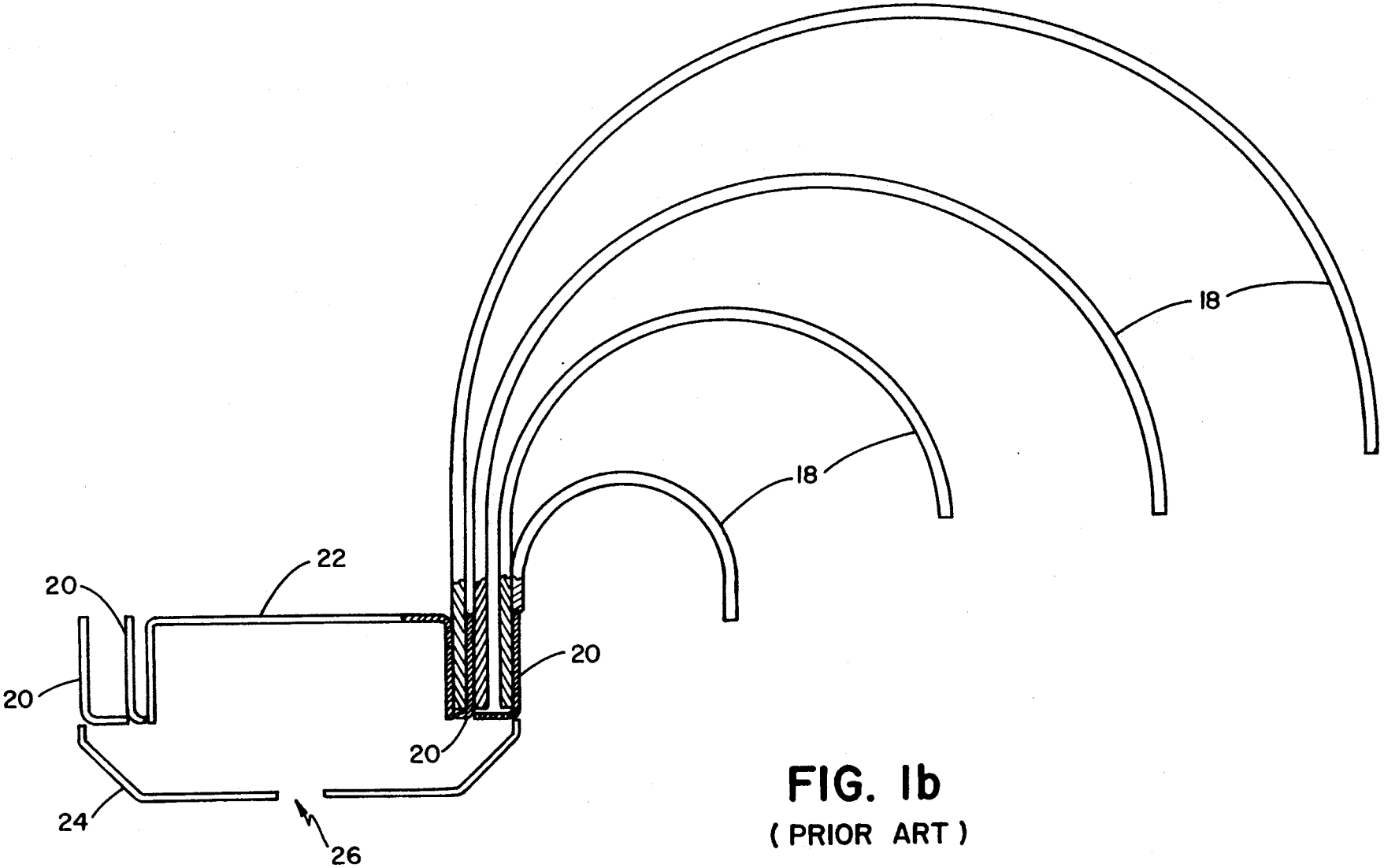
FIG. 1b (PRIOR ART)
FIG. 1*b* is a cross-sectional view of a portion of another conventional "shower" type chandelier assembly.
Figure 2:
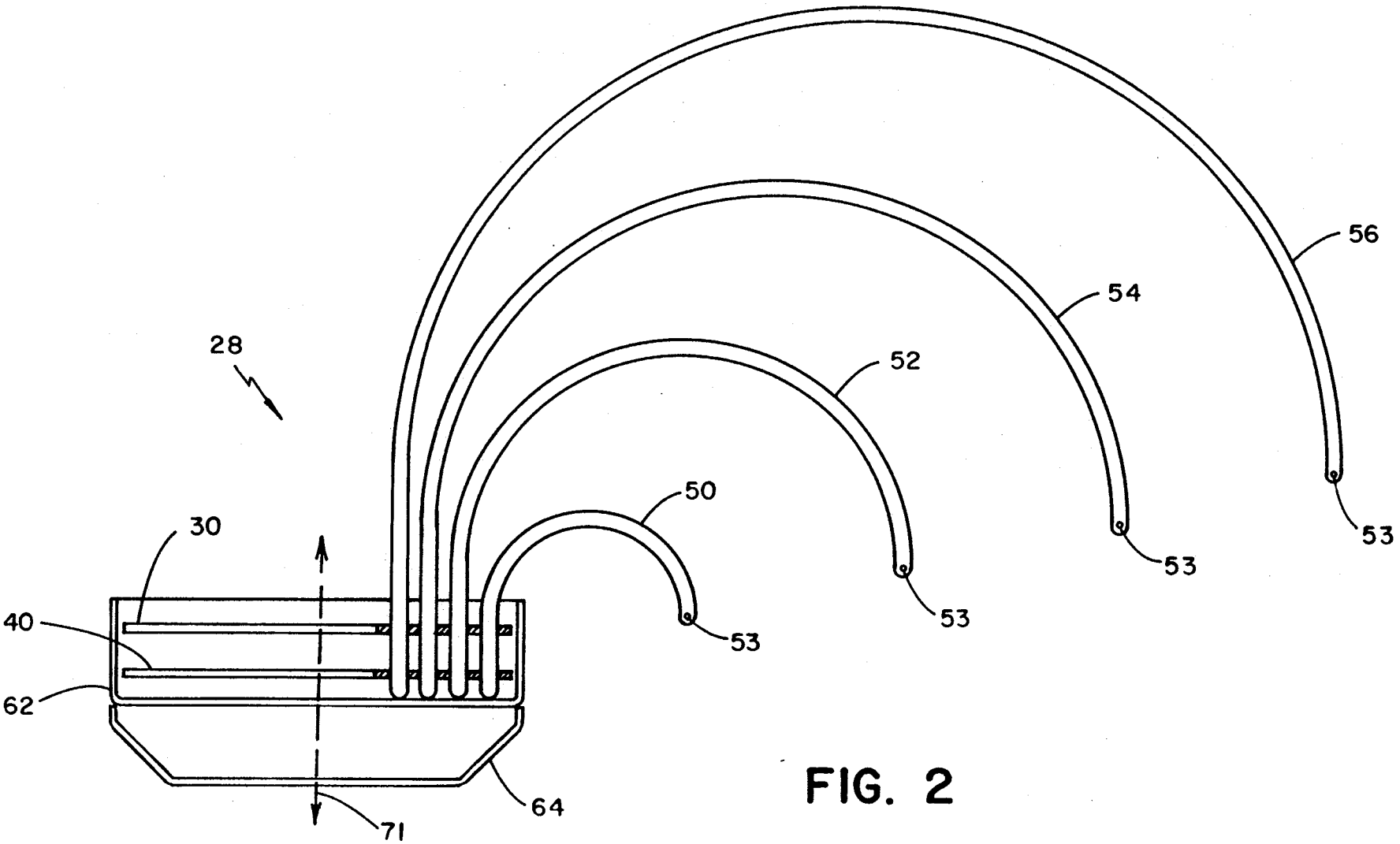
FIG. 2 is a cross-sectional view of a portion of a chandelier assembly in accordance with one embodiment of the present invention.

FIG. 2 shows a cross-sectional view of a portion of an illustrative chandelier assembly 28 in accordance with an embodiment of the present invention. For illustrative purposes, only four arms 50, 52, 54 and 56 are depicted in FIG. 2; additional arms typically are employed. These arms 50, 52, 54 and 56 each have a different extent of outward radial extension. The arms 50, 52, 54 and 56 can be made of a suitable metal that preferably is rolled on the edge (i.e. rolled on the thinner dimension of its substantially rectangular cross-section) to provide the arcuate shape of the arms. Those skilled in the art will know of other materials, such as plastic, from which the arms may be constructed. Since the arms are rolled "on the-edge", as opposed to being rolled "on the-flat", the arms have substantial strength to resist axial displacement (see transverse axis 71) when trim is added to the arms. This results in the need for less metal to achieve the desired strength and an overall delicate and pleasing appearance. The arms 50, 52, 54 and 56, however, may be any type of arm that is suitable for a chandelier assembly. The arms may have virtually any cross-sectional configuration. Different portions of the arm may even have different cross-sectional configurations. For example, see FIGS. 7A and 7B, below. Trim attachment openings 53 may be provided in the arms to facilitate the hanging of trim from the radially outermost end of the arms.

The arms 50, 52, 54 and 56 are shown as having an arcuate shape. It should be appreciated by those skilled in the art that other shapes are equally suitable. In addition, the arms need not extend radially outward, but rather may extend in virtually any direction. However, it will be understood that the configuration of the openings provided in the plates should be such as to account for the direction in which the arms are biased when the chandelier is assembled.

The radially innermost ends of the arms 50, 52, 54 and 56 pass through openings provided in a top plate 30 and a bottom plate 40 in a manner so as to be interlockingly engaged with the plates as will be described in more detail below. These plates 30 and 40 are supported parallel to each other within a holder 62 that serves to limit the extent to which the arms 50, 52, 54 and 56 may be advanced through the openings in the direction of the transverse axis (see 71 in FIG. 2). A bottom plate 64 may also be provided to enhance the aesthetic appearance of the assembly 28.

Figure 3A:
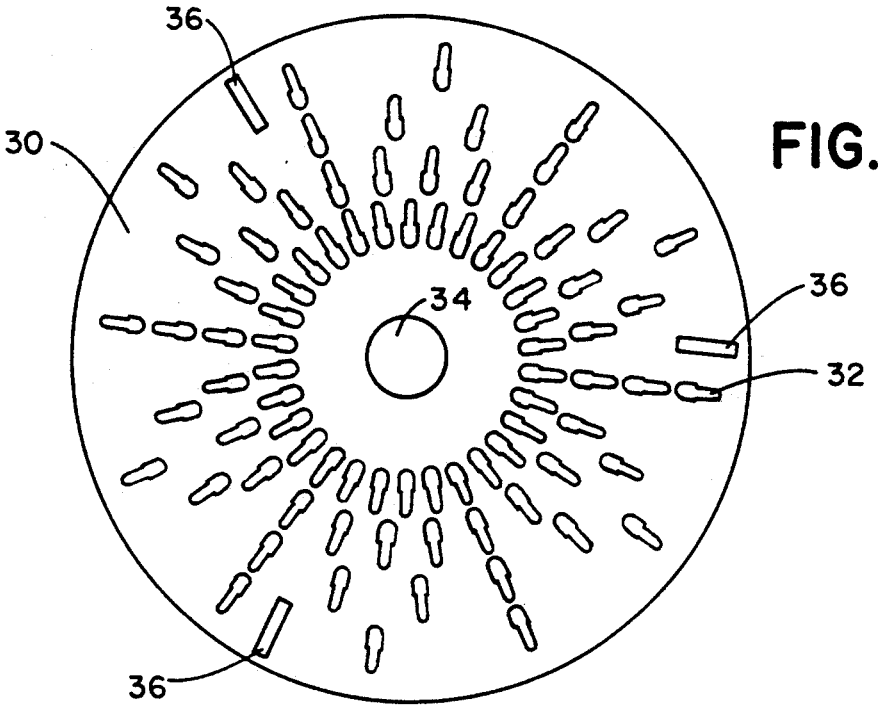
FIG. 3*a* is a plan view of the top plate employed within the chandelier assembly of FIG. 2.
Figure 3B:
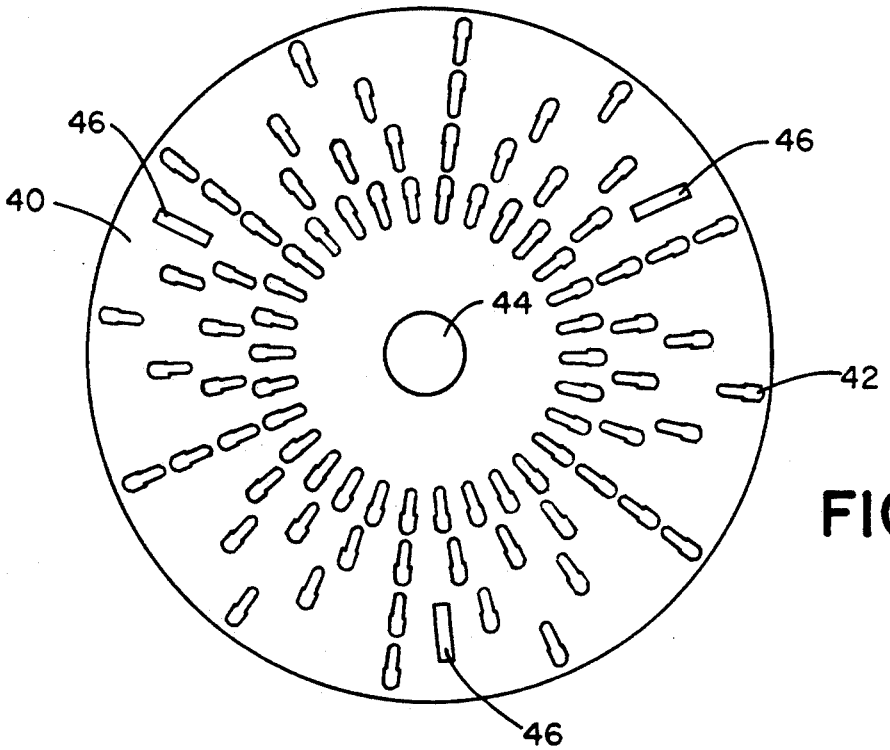
FIG. 3*b* is a plan view of the bottom plate employed in the chandelier assembly of FIG. 2.

FIGS. 3*a* and 3*b* are plan views of the top plate 30 and bottom plate 40 of the chandelier assembly. These plates 30 and 40 are preferably, but not necessarily, of like size and shape. In this embodiment, the plates 30 and 40 are disk shaped with the same outer diameter and thicknesses. Each plate has substantially planar opposing surfaces. Those skilled in the art will know of other equally viable sizes and shapes for the plates 30 and 40 based upon the teachings contained herein.

The plates 30 and 40 are preferably made of a material that is of sufficient strength to withstand the forces exerted by the arms when the chandelier is assembled. The material chosen for the plates 30 and 40 should be a material that is readily machined so that openings may be cut in the plates. Suitable materials include steel and steel alloys, brass, etc.

Both of the plates 30 and 40 have a predetermined pattern of openings cut in them by conventional techniques (preferably, stamp cutting). The configuration of each particular opening 32 cut into the top plate 30, however, differs from the configuration of each particular opening 42 cut into the bottom plate 40. Nevertheless, there is a one to one correspondence between each opening 32 on the top plate 30 and each opening 42 on the bottom plate 40. As such, the openings 32 and 42 are organized into pairs made up of a top plate opening 32 and a bottom plate opening 42. The alignment of these pairs of openings is important and will be discussed in more detail below.

Figure 3C:
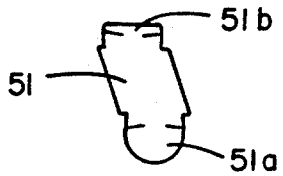
FIG. 3*c* is a plan view of a leg used to couple the top plate to the bottom plate.

A central hole 34 is provided in the top plate 30, and a central hole 44 is provided in the bottom plate 40. The central holes 34 and 44 allow the plates 30 and 40 to be passed over a stem of a chandelier. Additional openings 36 and 46 are provided on the plates 30 and 40, respectively, for interengagement with legs 51 (FIG. 3*c*). The legs 51 secure plates 30 and 40 together in a parallel stacked configuration and guarantee correct alignment of the arrays of openings in the two plates.

FIG. 3*c* shows an illustrative leg 51. The leg has a bottom portion or tab 51*a* that passes through an opening 46 in the bottom plate 40. The leg 51 through a corresponding opening 36 in the top plate 30. When the respective tabs 51*a* and 51*b* are in place, they are twisted relative to the remainder of the leg body to engage the substantially planar surfaces of the plates 30 and 40. Although only a single leg is depicted in FIG. 3*c*, it will be appreciated that multiple legs of similar construction are employed to secure the plates to one another.

A preferred method for constructing such tabs as well as a detailed description of the preferred configuration for such tabs is described in copending application Ser. No. 07/539,854, filed Jun. 18, 1990. It, however, will be understood by those of ordinary skill in the art that many other devices for securing the plates to one another could be used, such as bolts, spacers and the like.

Figure 4A:
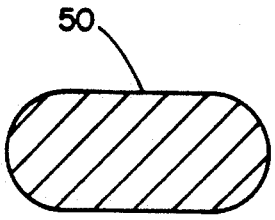
FIG. 4*a* is a cross-sectional view of an arm employed with the chandelier of FIG. 2.
Figure 4B:
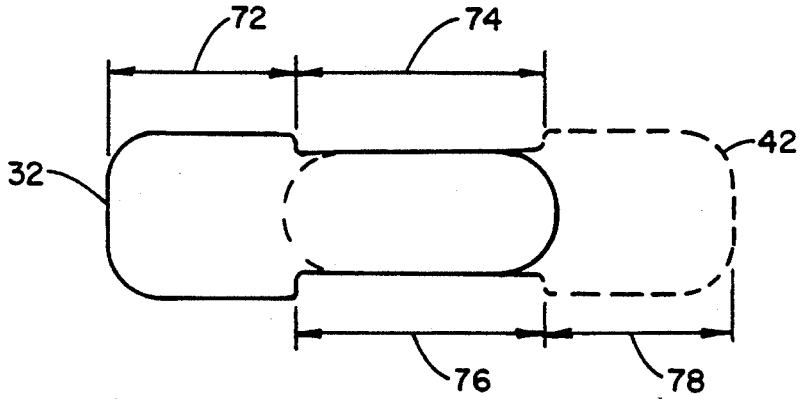
FIG. 4*b* is a plan view of a pair of aligned openings on the top and bottom plates.

FIG. 4*a* shows a cross-section of arm 50. FIG. 4*b* shows a plan view along transverse axis 71 of the openings 42 (dotted line) and 32 (solid line) when the plates are properly secured and aligned relative to each other. The opening 32 on the top plate may be divided into two regions 72 and 74. Region 72 is a non-restrictive region having a cross-sectional configuration greater than that of arm 50 (FIG. 4*a*). Region 74, in contrast, is a restrictive region having a cross-sectional configuration closely matched to arm 50 (FIG. 4*a*). The two regions, in combination, form an opening shaped much like a key hole.

Opening 42 includes two similar regions 76 and 78, wherein region 78 is a non-restrictive region and region 76 is a restrictive region. Thus, the openings 32 and 42 are shown in FIG. 4*b* to have a like geometry. Opening 32 differs from opening 42, however, in that opening 32 is oriented in a direction 180° relative to opening 42. These oppositely directed openings are aligned so that their restrictive regions 74 and 76 overlap when viewed an axis transverse to the planes defined by the plates.

Figure 5A:
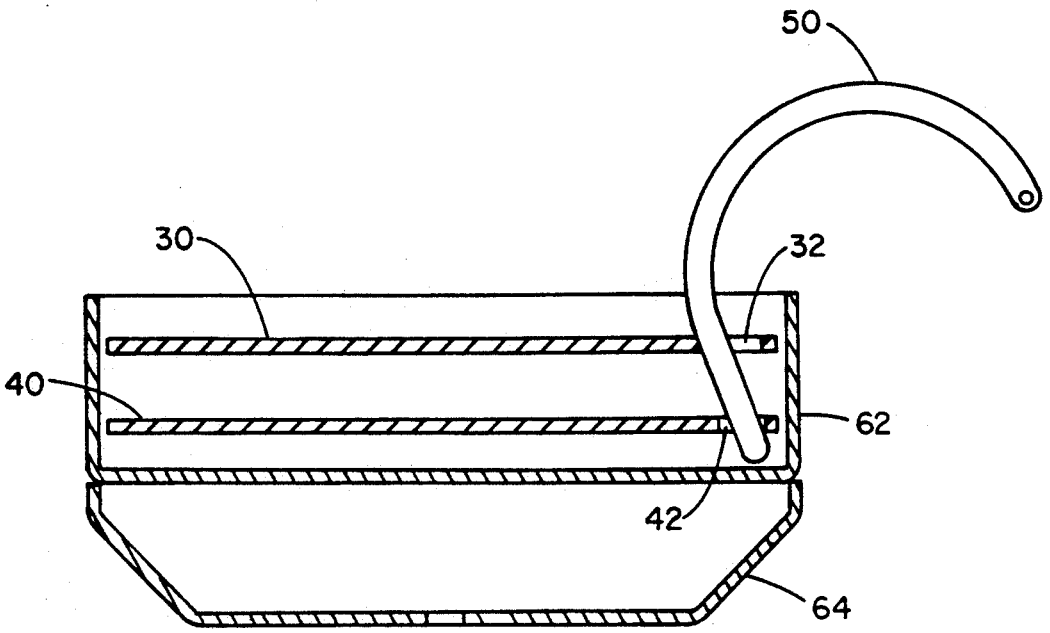
FIGS. 5*a* and 5*b* are cross-sectional views of the chandelier assembly of FIG. 2 illustrating the installation of an arm into the assembly.
Figure 5B:
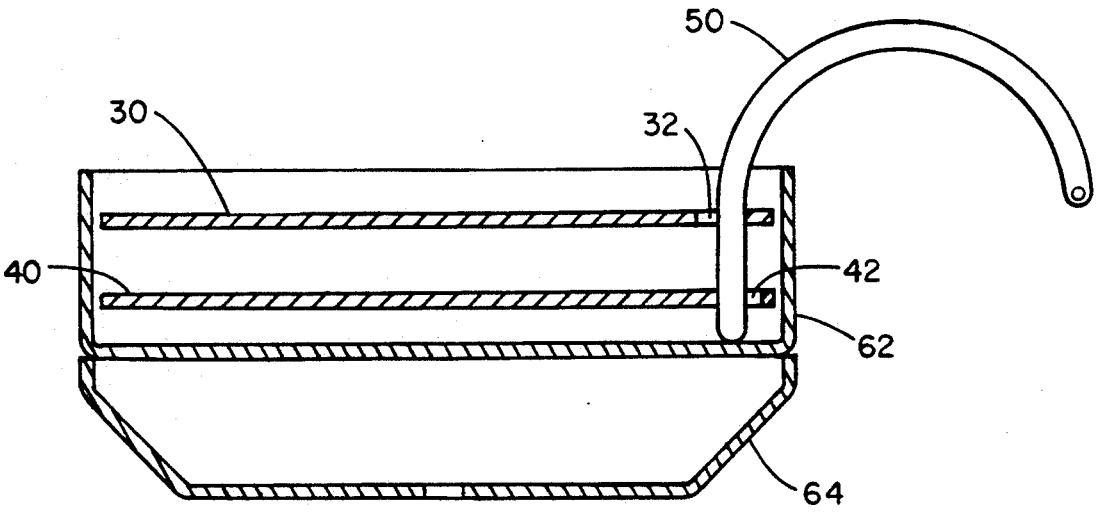

To pass arm 50 through the openings, it is angled (FIG. 5*a*) relative to its interlocked position (FIG. 5*b*) so that it may pass relatively freely through the non-restrictive regions of the openings. Since these non-restrictive regions 72 and 78 have a greater cross-sectional diameter than the cross-sectional diameter of the arm 50, the arm may be readily moved through the openings at this first angle. To interlockingly engage the arm 50 to the plates, the arm 50 is moved until it assumes the position of FIG. 5*b*. In this position, the arm 50 rests within the restrictive regions 74, 76 of the openings. These restrictive regions 74 and 76 have a cross-sectional area closely matched to that of the cross-section of the arm. Thus, the arm may not be rotated within the openings or moved laterally within the opening (i.e. from side to side). Also, since the arm 50 abuts the radially innermost edge of opening 42 and radially outermost edge of opening 32, the arm may not be further displaced radially outwardly. The openings, hence, help to maintain the extent of radial displacement of the arm 50 when trim is applied to the arm.

Thus, it should be understood that the angle of the arm with respect to the plates means the angle defined by the longitudinal axis of the portion of the arm extending into the plates relative to the plane defined by the plates. It does not mean the rotational orientation of the arm with respect to the plates.

Figure 6A:
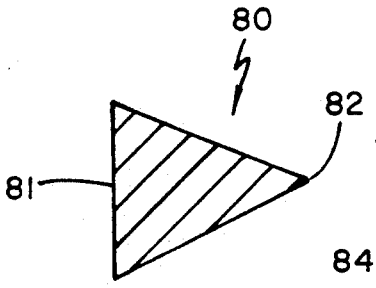
FIG. 6*a* is a cross-sectional view of an alternative arm construction.

The opening configuration described above is merely illustrative. The types of openings that are cut into the plates 30 and 40 are in large part based upon the cross-section of the arms that are used in the chandelier assembly. Innumerable configurations are possible. Moreover, as will be understood by those of ordinary skill in the art, the pairs of holes need not have like geometry to obtain certain of the advantages of the invention. For example, the arm 80 may have a triangular cross-section like that shown in FIG. 6*a*, wherein in the assembled chandelier flat surface 81 is the radially innermost side of the arm and apex 82 is the radially outermost side of the arm. Openings such as those shown in FIG. 6*b* then may be employed to provide interlocking engagement of the arm 80 to the plates.

Figure 6B:
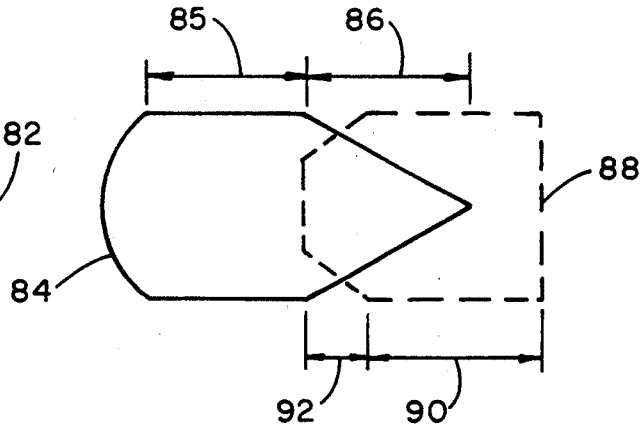
FIG. 6*b* is a plan view of openings provided in the top and bottom plates for interlockingly engaging the arm of FIG. 6*a;*

Referring to FIG. 6*b*, opening 84 can be provided on the top plate and can have a substantially rectangular non-restrictive region 85 and a triangular restrictive region 86. The bottom plate opening 88 has a different geometry. In this opening 88, both the non-restrictive region 90 is rectangular in shape and the restrictive region 92 is trapazoidal in shape. To interlockingly engage an arm in these openings, the arm is initially angled to pass through the non-restrictive regions. The arm then is moved to a position where it engages the restrictive regions 86, 92 where it is interlockingly engaged in place.

Figure 7A:
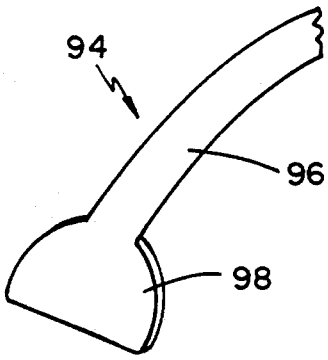
FIG. 7*a* is a perspective view of still another arm construction.
Figure 7B:
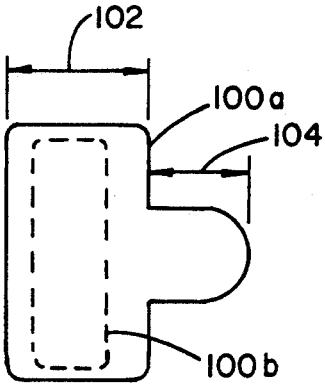
FIG. 7*b* is a plan view of openings provided in top and bottom plates for interlockingly engaging the arm of FIG. 7*a*.

Another example of plate opening and arm configurations is shown in FIGS. 7A and 7B. In this example, the arm 94 has a main portion 96 having a circular cross-section, except that the radially innermost end 98 is forged flat. The flat portion can engage an opening 100*b* in the bottom plate having a substantially restrictive, mating configuration, restricting lateral and radial movement, thereby preventing rotation as well. The portion of the arm adjacent to the forged flat end and having a circular cross-section can engage an opening 100*a* having both a non-restrictive portion 102 and a restrictive portion 104. The non-restrictive portion 102 is adapted to permit easy passage of both the forged end 98 and circular portion 96 of the arm 94. The restrictive portion 104, on the other hand, is adapted to receive only the circular portion 96 of the arm 94. It will be readily understood that the opening 100*b* in the bottom plate can be made narrower than the diameter of the circular portion 96, whereby interengagement of the circular portion 96 of the arm 94 immediately adjacent the forged portion and the surfaces defining the opening 100*b* limit axial advancement of the arm 94 into the opening 100*b*. Thus, the arm could be said to have a protrusion acting as a stop to axially position the arm with respect to the plates.

It further will be understood by one of ordinary skill in the art that the configuration of the holes and the arm may be adapted in other ways to resist axial displacement of the arm within the holes when the device is assembled. For example, the openings of FIG. 4*b* may be aligned such that the non-restrictive portions overlap. As such, the arm will extend radially outwardly from the plates at a slight angle with respect to the transverse axis 71. The weight of the arm alone, but particularly when taken together with the weight of the ornament, will tend to bias the arm in the direction of engagement with the non-restrictive portion of the openings. This engagement acts to frictionally secure the arms against axial displacement as well as to hold them within the non-restrictive portions of the openings. This advantage of course is obtained even in the configuration shown in FIG. 4*b*, provided that the arm is configured so as to bias that portion of the arm engaging the plates in the proper direction.

The present invention provides a number of benefits over conventional chandelier assemblies. First, the present invention avoids welding. Second, because the openings are configured to easily interlock the arm upon manual engagement, the chandelier assembly is more quickly and easily constructed. Third, the openings are constructed so as to ensure proper alignment of the arms both laterally and axially. The resistance of displacement axially is so that attachment of trim to the arms does not skew the axial alignment of the arms.

An additional benefit provided by the present invention is that the chandelier assembly may be readily disassembled. This benefit becomes especially important during repair or when the chandelier must be cleaned. Given the ease with which the chandelier may be assembled and disassembled, it is ideally suited to be shipped as a kit in which the parts are shipped disassembled. Upon arrival at the destination, the parts may be easily assembled. The parts may thus be shipped in a fashion that more readily protects the parts and prevents breakage or bending of the arm of the chandelier.

While the present invention has been shown with respect to preferred embodiments thereof, those skilled in the art will know of other alternative embodiments which do not depart from the spirit and scope of the invention as defined in the appended claims.

I claim:

1. A chandelier assembly including an arm for supporting an ornament comprising:

a first plate having opposing substantially planar surfaces and a first opening extending through the opposing surfaces of the first plate;

a second plate remote from and fixedly positioned relative to the first plate, the second plate having opposing substantially planar surfaces and a second opening extending through the opposing surfaces of the first plate, the first and second openings having side edges located between each of the planar surfaces and the first and second openings being a pair of openings; and the extending through the pair of openings and biased into an engagement with the plates in a manner so as to secure the arm against rotation and rocking with respect to the plate, wherein the pair of openings and the arm are constructed and arranged so that the arm is in engagement with at least a portion of the side edges of the pair of openings and is free of engagement with the planar surfaces of the plates when assembled.

2. A chandelier assembly as recited in claim 1 wherein each of the first and second plates include centers and wherein said arm is aligned substantially radially relative to the centers, the arm including a radially innermost end more proximate to the center and a radially outermost end more remote from the center and further comprising means for controlling the position of the radially innermost end of said arm.

3. A chandelier assembly as recited in claim 1 further comprising additional pairs of openings in the first and second plates and additional arms that each pass through one of the pairs of openings and are biased into engagement with the plates.

4. A chandelier assembly as recited in claim 3 wherein each of the first and second plates include centers and wherein at least two of the pairs of openings are elongated along a radial direction relative to the centers and wherein the at least two pairs of openings are radially aligned relative to the centers.

5. A chandelier assembly as recited in claim 1 further comprising connectors attaching the plates parallel to one another.

6. A chandelier assembly as recited in claim 1 wherein the arm is rolled on edge.

7. A chandelier assembly kit for a chandelier having an arm, comprising:

a first plate having a first opening, said first opening, comprising:

a non-restrictive portion, having a size that is greater than a cross-section of the arm, so that the arm may be readily passed through the non-restrictive portion when the arm is positioned at a first angle relative to the first plate, and a restrictive portion, having a size that is closely matched to at least a portion of the cross-section of the arm, so as to frictionally engage the arm to prevent rotation when the arm is positioned at a second angle relative to the first plate, said second angle being different from the first angle;

a second plate having a second opening, said second opening, comprising:

a non-restrictive portion, having a size greater than the cross-section of the arm, so that the arm may be readily passed through the non-restrictive portion when the arm is positioned at the first angle, and a restrictive portion, having a size that is closely matched to at least a portion of the cross-section of the arm, so as to frictionally engage the arm to prevent rotation when the arm is positioned at the second angle; and an arm for insertion into the openings, wherein the openings and arm are constructed and arranged so that, when the arm is positioned at the first angle, the arm may be readily moved through the non-restrictive portions of the first and second openings and when the arm is positioned at the second angle, the arm is interlockingly engaged by the restrictive portions of the first and second openings to prevent rotation and lateral movement of the arm.

8. A chandelier assembly kit as recited in claim 7 wherein the restrictive portion of the first plate restricts radial displacement of the arm in a first direction when the arm is at the second angle, and the restrictive portion of the second plate restricts radial displacement of the arm in a second direction, which is opposite the first direction when the arm is at the second angle.

9. A chandelier assembly kit as recited in claim 7 further comprising a stop associated with the plates for controlling the position of a radially innermost end of said arm, when assembled.

10. A chandelier assembly kit as recited in claim 7 wherein the first and second openings are a pair of openings and further comprising additional pairs of openings and additional arms received within the additional pairs of openings that are interlockingly engaged by restrictive portions of the additional pairs of openings to prevent rotation and lateral movement of the arms.

11. A framework for supporting at least one chandelier arm extending in a radial array about the framework comprising, a first plate having a first plate opening tapered in a first direction, and a second plate attached to and spaced from the first plate, the second plate having a second plate opening aligned with the first plate opening along an axis substantially transverse to the plates and wherein the second plate opening is tapered in a second direction oriented 180 degrees relative to the first plate opening wherein the arm is positioned through each of the first plate opening and the second plate opening.

12. A framework as claimed in claim 11 further comprising a plurality of tapered first plate openings arranged in a predetermined array and a plurality of tapered second plate openings arranged in the same predetermined array, the array of openings on the first plate being aligned with the array of openings in the second plate thereby forming an array of pairs of openings, the tapers of each pair of openings being oriented in opposite directions.

13. An assembly for forming a chandelier framework having an arm comprising, a first plate having a first plate opening tapered in a first direction, and a second plate attached to and spaced from the first plate, the second plate having a second plate opening aligned with the first plate opening along an axis substantially transverse to the plates and wherein the second plate opening is tapered in a second direction oriented 180 degrees relative to the first plate opening, the arm constructed and arranged to be received within the first plate opening and second plate opening and locked against rotation and lateral rocking when biased in the direction of the taper, but free for limited rotation when biased in the direction away from the taper, and a container containing the plates and the arm.

14. A framework including an arm for supporting chandelier ornaments comprising:

a first plate having a first plate opening, a second plate attached to and spaced from the first plate, the second plate having a second plate opening aligned with the first plate opening, and the arm supporting an ornament at a first end of the arm and received within the openings at a second end of the arm, wherein the ornament biases the arm in a first direction into an engagement with the plates that frictionally locks the arm to the plates, and wherein the openings and arm are constructed and arranged so that the arm is released from frictional engagement with the plates when biased in a second direction opposite to that of the first direction.

15. A chandelier assembly including an arm, comprising:

a first plate having an opening, said opening being tapered in a first direction, a second plate, attached to and spaced from the first plate, having an opening that is tapered in a second direction, wherein the second direction is oriented 180 degrees relative to the first direction, and the arm biased in the first direction that passes through the opening in the first plate and the opening in the second plate and engages the tapered ends of the openings.

16. A chandelier assembly as recited in claim 15 wherein said arm is biased by gravitational force.

17. A chandelier assembly as recited in claim 15 further comprising a stop for controlling the position of a radially innermost end of said arm.

* * * * *

UNITED STATES PATENT AND TRADEMARK OFFICE

CERTIFICATE OF CORRECTION

PATENT NO. : 5,258,900

DATED : November 2, 1993

INVENTOR(S) : Georg Bayer

It is certified that error appears in the above-indentified patent and that said Letters Patent is hereby corrected as shown below:

Column 7 line 60, after "the" and before "extending", please insert --ornament bearing arm--.

Signed and Sealed this

Twenty-first Day of March, 1995

Bruce Lehman

*Attest:*

BRUCE LEHMAN

*Attesting Officer*

*Commissioner of Patents and Trademarks*